US005421462A

United States Patent [19]

Hofbauer et al.

[11] Patent Number: 5,421,462

[45] Date of Patent: Jun. 6, 1995

[54] ARRANGEMENT FOR DRY RECONDITIONING OF USED FOUNDRY SANDS

[75] Inventors: Hermann Hofbauer, Vienna, Austria; Erich Muller, Alfeld, Germany; Erhard Putzig, Hanover, Germany; Ekart Schaarschmidt, Alfeld, Germany

[73] Assignee: Kunkel-Wagner GmbH & Co. KG, Alfeld, Germany

[21] Appl. No.: 39,308

[22] PCT Filed: Aug. 13, 1992

[86] PCT No.: PCT/EP92/01858

§ 371 Date: Jul. 12, 1993

§ 102(e) Date: Jul. 12, 1993

[87] PCT Pub. No.: WO93/03872

PCT Pub. Date: Mar. 4, 1993

[30] Foreign Application Priority Data

Aug. 14, 1991 [DE] Germany ..... 41 26 976.4

[51] Int. Cl.[6] ..... B07B 7/04

[52] U.S. Cl. ..... 209/143; 209/139.1; 209/149

[58] Field of Search ..... 209/138, 139.1, 141, 209/142, 143, 144, 146, 147, 149

[56] References Cited

U.S. PATENT DOCUMENTS

| | | | |
|---|---|---|---|
| 4,226,673 | 5/1981 | Haidlen et al. | 209/141 X |
| 4,257,880 | 3/1981 | Jones | 209/144 |
| 4,260,478 | 4/1981 | Hosokawa et al. | 209/144 X |
| 5,120,431 | 6/1992 | Cordonnier | 209/144 X |

FOREIGN PATENT DOCUMENTS

| | | | |
|---|---|---|---|
| 0060394 | 9/1982 | European Pat. Off. . | |
| 2233111 | 1/1974 | Germany . | |
| 135862 | 6/1979 | Germany . | |
| 2856536 | 10/1979 | Germany . | |
| 2949618A1 | 6/1981 | Germany . | |
| 3909535A1 | 10/1990 | Germany . | |
| 1599136 | 10/1990 | U.S.S.R. | 209/139.1 |
| 1738389 | 6/1992 | U.S.S.R. | 209/139.1 |

OTHER PUBLICATIONS

Official Letter from the German Patent Office dated Mar. 5, 1992 (4 pages).

Translation of Official Letter from the German Patent Office Dated Mar. 5, 1992 (3 pages) See MPEP Sec. 609 at pp. 600–67,68 (Rev. 14 Nov. 1992).

Copy of Intl. Search Report cover sheet(?), 3 pgs. dated Oct. 19, 1992 (form PCT/ISA/220, Jul. 1992); and accompanying Search Report listing cited (Cont'd.) art, 3 pgs. dated Oct. 19, 1992 (Form PCT/ISA/210, Jul. 1992). See M.P.E.P. Sec. 609 at pps. 600–67,68 (Rev. 14 Nov. 1992).

*Primary Examiner*—James R. Bidwell
*Assistant Examiner*—Tuan N. Nguyen
*Attorney, Agent, or Firm*—Barnes, Kisselle, Raisch, Choate, Whittemore & Hulbert

[57] ABSTRACT

An arrangement for the dry reconditioning of used foundry sands in which used sand is fluidized with air or an air/gas mixture and flung against a precipitator to separate and remove substances covering sand particles. The precipitator has several planar baffle elements arranged in concentric circles around a conical deflector. A jet of used sand/air directed toward the deflector expands radially outwardly toward the baffle elements so that the jet is decelerated several times by the deflector and the baffle elements and, in a confined space, split into individual streams and swirled to provide heavy mechanical friction between sand particles and between sand particles and the baffle elements.

13 Claims, 3 Drawing Sheets

ARRANGEMENT FOR DRY RECONDITIONING OF USED FOUNDRY SANDS

FIELD OF THE INVENTION

The present invention relates in general to an arrangement for the dry reconditioning of used foundry sands and in particular to an arrangement for the dry reconditioning of used foundry sands, in which said used sand containing binder covers and impurities and air of ambient temperature or an air/gas mixture heated to a maximum of 550° C. can be supplied to a mechanical cleaning step in the form of a multi-cell separator and each separator cell having: an ascending pipe open at both ends; a precipitator arranged at a distance above and opposite the upper outlet opening of the ascending pipe having an axis and comprising surfaces decelerating and deflecting the used sand/air or used sand/gas-/air jet; fan means for supplying said air or said air-gas mixture; feed means for feeding the sand and conveying the sand from one separator cell to the other separator cell, respectively; means for removing the sand from said separator; means for collecting and removing the resulting covering and impurity substances.

BACKGROUND AND FEATURES OF THE INVENTION

Such arrangements are known from DE-PS 28 56 536, DE-OS 39 09 535, EU-A1-00 60 394, U.S. Pat. No. 4,266,673 or DE-OS 22 33 111, for example.

As follows from DE-PS 28 56 536, the objective of these arrangements is not only to separate the binder covers from the sand grains but also to separate the sand from the isolated coverings and other impurities inside the arrangement and during the treatment. In the latter citation additional outlet openings for a secondary gas stream are arranged in a certain manner about the ascending pipe for this purpose so as to obtain a local limited uniform flow-through which acts in the same direction all around. The separation means used is an impingement plate arranged at a distance over the outlet opening of the ascending pipe. Several separator cells are disposed in a joint upper housing box, an outlet chamber being arranged above the impingement plate for each separator cell, into which chambers the gas leaving the impingement plate flows together with the separated particles of material. These chambers are connected to a joint exhaust-air collector. At a distance below the outlet opening of the ascending pipe each separator has a screen-like catch means developed in such a way that it conveys a partial stream of the sand stream coming down from the impingement plate in a veil-like manner to the next separator cell while the other partial stream is supplied back again to the inlet nozzle of the ascending pipe. On the whole, this arrangement is expensive and leaves a lot to be desired during sorting as regards the separating cut.

Another drawback consists in that great forces have to be expended for separating the binder covers, owing to which the sand grains are partially destroyed at the impingement plate and the sand grain structure is changed in undesired manner.

In order to reduce the expenditure, a special swirling step is assigned to the outlet end of the ascending pipe of the arrangement according to the above-mentioned laid-open print. By this the escaping air current is to expand partially radially by taking along impurities contained in the used sand so as to impinge on the mass of sand, dust and air, which falls down from the impingement plate, thus better removing the fines. In order to improve this effect, the impingement plate extends relatively far downwardly and is constricted at its lower outlet end. The separation of the binder covers from the sand grains is not improved by this.

The object of this invention is to further develop said initially mentioned arrangement in such a way that accompanied by a space-saving design both the separation of the binder covers from the individual sand grains and sorting can markedly be improved, so that the effectiveness of the reconditioning can markedly be increased in each separator cell, the sand grain structure being maintained as completely as possible.

This problem is solved by an arrangement for the dry reconditioning of used foundry sands, in which the used sand contains binder covers and impurities and air of ambient temperature or an air/gas mixture heated to a maximum of 550° C. can be supplied to a mechanical cleaning step in the form of a multi-cell separator and each separator cell having an ascending pipe open at both ends; a precipitator arranged at a distance above and opposite the upper outlet opening of the ascending pipe having an axis and comprising surfaces decelerating and deflecting the used sand/air or used sand/gas-/air jet; fan means for supplying the air or the air-gas mixture; feed means for feeding the sand and conveying the sand from one separator cell to the other separator cell, respectively; means for removing the sand from the separator; means for collecting and removing the resulting covering and contaminating (impurity) substances, characterized in that the precipitator of the or each separator cell has several planar elements in addition to the surfaces decelerating and deflecting the jet rising through the ascending pipe, which elements are distributed at mutual peripheral distances about the axis of the ascending pipe; whereby each element projects into the flow of the deflected jet in a decelerating fashion thus dividing it into partial jets and swirling it.

Above all, the arrangement is suitable for the dry reconditioning in a plant in which the used sand is treated with air or an air/gas mixture of relatively low temperature reaching a maximum of 550° C. preferably markedly less, so that it is possible to use above all the clay-like binders and brighteners separated from the sand grains of the used sand as binders again.

Due to the development of the novel arrangement, particularly the embodiments according to the subfeatures, the precipitator of each separator cell holds out a plurality of friction and swirling surfaces to the decelerated and deflected stream of material leaving the ascending pipe, which convey this stream of material, subdivided into a plurality of partial streams, along the friction surfaces and strongly swirl it thus causing the sand grains to get into a strongly stirring relative motion in the area of the precipitator. A high efficiency is obtained during the separation of the binder covers by the subdivision into partial streams and the strong swirling thereof in a confined space. At the same time, a classification of the solids particles is achieved in the area of the precipitator and its planar elements. The coarser particles or sand grains remain in the region of the radially planar elements while the separated binder particles and the fine impurities are conveyed and removed upwardly by the air stream flowing outwardly through the baffles formed by the planar elements. The separation of the finer particles is further improved by the subdivision into partial streams and the intense enlargement of the surface of the flowing mixture accompanied by this. The differing sand grains conveyed downwardly, while subjected to friction, along the planar elements at varying distance from the axis of the ascending pipe in a coronal fashion are exposed to a strong friction effect and further sorting when leaving the deflecting element, since part of the carrier air or carrier air/gas mixture also flows downwardly and, when leaving the planar elements of the precipitator, flows outwardly and upwardly to the outlet by conveying finer particles upwardly. This serves for obtaining not only a very intense cleaning effect but also reliable and effective sorting. Additional expansion spaces or means for supplying additional air serving for sorting are not required.

As a result, the arrangement can also be developed in a relatively simple manner and arranged in space-saving fashion.

The further subfeatures provide for an especially favorable embodiment of the precipitator. The arrangement, in the flow direction, of the cells of each separator and of the supply, discharge and transfer pipes along downwardly slanted lines, preferably in a dense fashion, leads to an especially simple control of material and a compact arrangement which can substantially be operated automatically and continuously. These advantages are further enhanced when at least part of the planar elements of the precipitator are V-shaped—viewed in the direction of sight in parallel with the axis of the ascending pipe; a sheet is arranged within the housing in the direction of a transfer pipe extending to the next separator cell, which sheet covers the housing cross-section only partially but is arranged in such a way that the used sand may slip on the sheet into the discharge transfer pipe; a shutter is disposed at the end of each transfer pipe, which is automatically closed by the sand sinking downwardly in the housing until the sand has fallen below the shutter level; and/or the precipitator element of each separator cell is arranged in a double-conical part of the separator housing in such a way that a gap having a width of at least half the radial dimension of the planar plate remains between the inner wall of this member and the periphery of the precipitator, the upper truncated cone being connected to the means for removing the separated covering substances and the like.

Further advantageous features will be apparent in the following description.

BRIEF DESCRIPTION OF THE DRAWINGS

The invention is described in more detail below by way of embodiment and with reference to diagrammatic drawings.

DETAILED DESCRIPTION OF THE INVENTION

Figure 1:
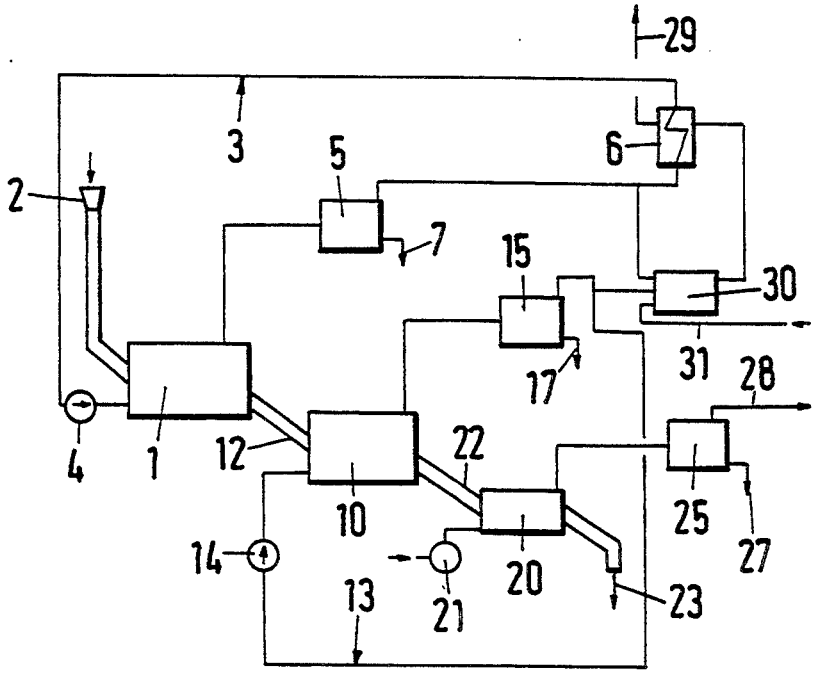
FIG. 1 shows a reconditioning plant for used foundry sand by way of diagram, in which the arrangement according to the invention can be employed advantageously.

The arrangement according to the invention is used in an especially advantageous manner for the dry reconditioning of used foundry sands in plants in which the used foundry sand is treated at relatively low temperatures reaching only a maximum of 550° C. In a preferred embodiment the used sand is treated in a first separator step 1 with an air-gas mixture having a temperature of about 300° C. The used sand is prepared beforehand as usual by separating metal particles and the like and fed into the separator 1 at 2. The air-gas mixture is supplied through a fan 4 and comes through pipe 3 from a heat exchanger 6 connected to a burner cycle 30 whose waste air is supplied at 29. With respect to the air-gas mixture the separator 1 is connected to form a closed cycle via a precipitator 5 in which the waste air leaving the separator 1 is freed from dust and fines and supplied again to the heat exchanger 6. The separated solids are discharged at 7. In the case of the reconditioning plant shown, the materials discharged at 7 predominantly consist of reusable active binder components which can be selected in corresponding bins.

Part of the separated substances can also be supplied to the burner 30 as fuel, and part of the air can be fed to the burner as a medium to be heated. In this case, some fresh air is supplied to the cycle mixture.

Via the transfer pipe 12 the sand treated in separator 1 reaches a second separator 10 where the used sand is treated again with recycling air of markedly reduced temperature in the same manner. The air is supplied through the fan 14, while the used sand 22 treated is fed to a cooler 20 where the sand is cooled to the desired operating temperature by means of the fan 21. From there the sand is conveyed to a sand bin 20 through pipe 23. The cycle air is fed from separator 10 to a precipitator 15. The separated solids are supplied to the burner just like part of the air as fresh air. The still lacking fuel amounts can be fed separately to the burner through pipe 31. The solids particles separated from the cooling air at 25 and collected at 27 can also be supplied to the burner while the purified cooling air is discharged into the atmosphere at 28.

The separators 1 and 10 are developed in substantially the same manner. Each separator 1 or 10 consists of one or more parallel-connected rows of several separator cells 38*a* to 38*f* or 48*a*, etc. Each separator cell forms an isolated unit separated from the other separator cells by a housing 60, 61 (FIG. 3), which unit consists of a hollow-cylindrical lower housing section 61 and an upper double-tapered housing 60.

As follows from FIG. 2, the individual separator cells are arranged densely in the flow-through direction along a sloping line. The supply pipes 40*a* and 50*a*, respectively, for the air/gas mixture or the process air, which are connected to the lower ends of the cells, as well as the collecting pipes 41 and 51, respectively, for the separated covering particles and foreign substances, with which the double-tapered housing member 60 is connected via the socket 77, also have a corresponding, relatively steep inclination.

Figure 2:
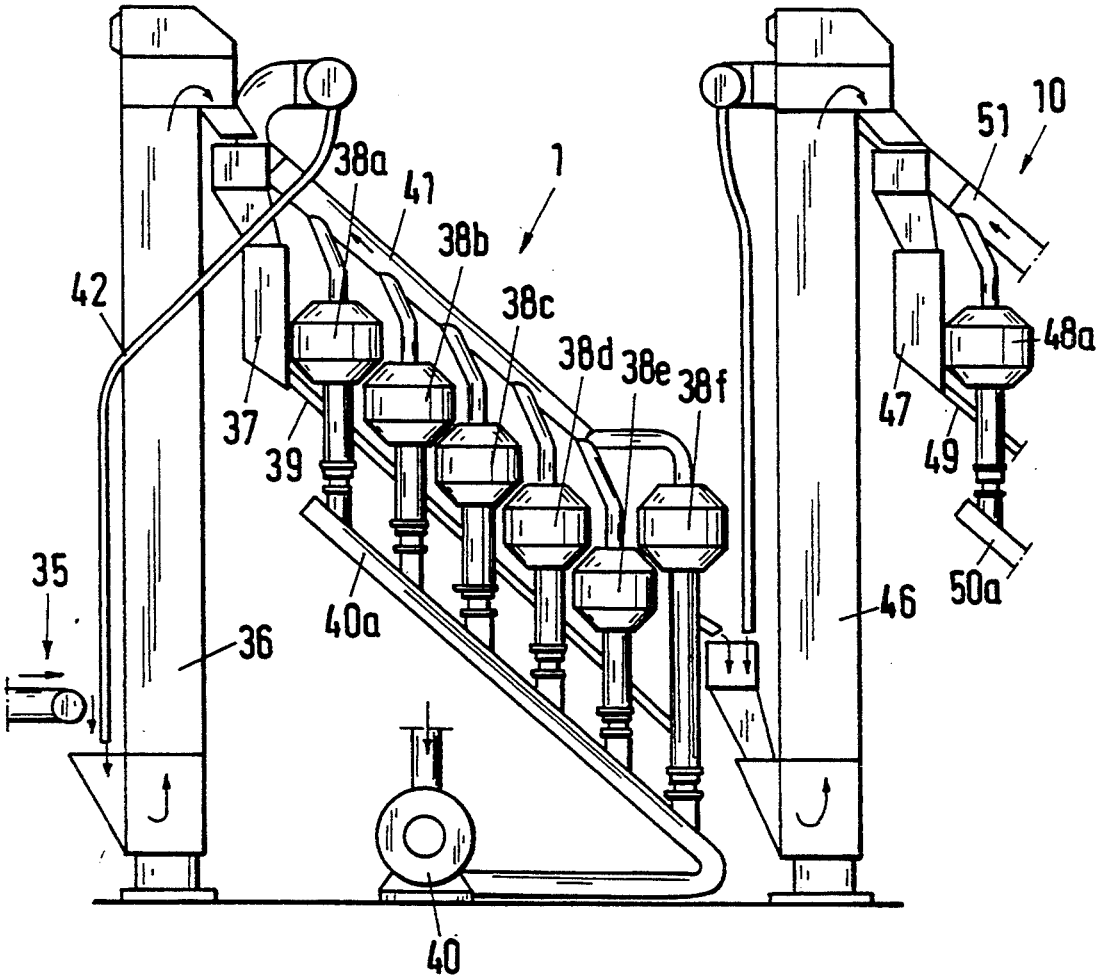
FIG. 2 shows a section of the arrangement according to the invention in a preferred embodiment as usable for the reconditioning plant according to FIG. 1.

The feed point for the used sand, shown in FIG. 1 at 2, is illustrated in FIG. 2 by a belt conveyor 35 and a bucket elevator 36 and 46, respectively. In this case, the used sand is supplied to the lower housing member 61 of the separator cell at 37 and via a corresponding transfer pipe 39 of downward inclination, as shown by the transfer pipe 68 in FIG. 3.

Figure 3:
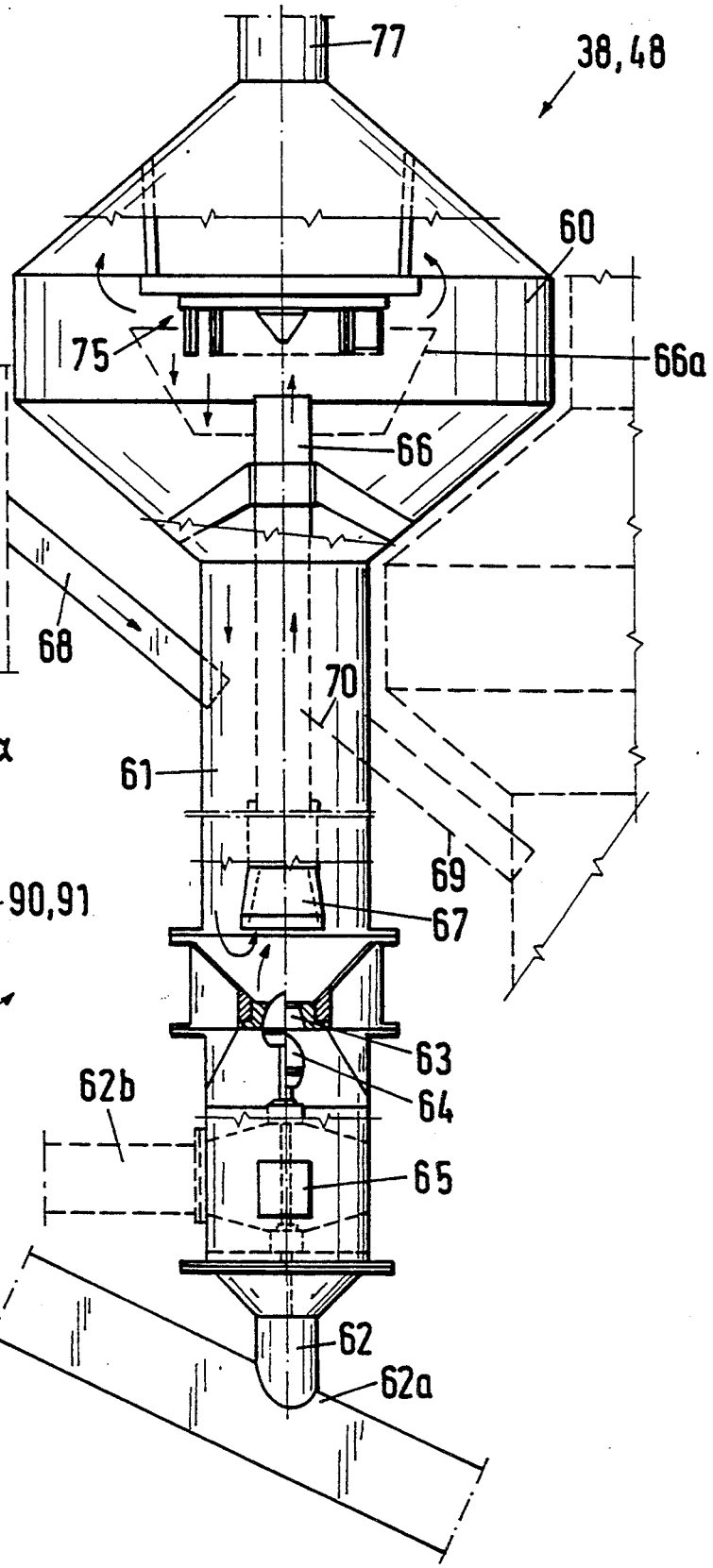
FIG. 3 shows, on an enlarged scale and in side view and partially broken away, a separator cell as preferably usable in row arrangement for the separators according to FIG. 2.

In FIG. 3 the distributing pipe for the gas/air mixture or air is designated as 62*a*. The separator cell 38/48 is connected thereto via the lower inlet connection 62. The air or the airgas mixture could also be supplied at 62*b* as outlined in FIG. 3 in dashed lines. A valve-like assembly 53 is provided in the lower portion of the housing 61, with which the valve member 64 movable in the perpendicular direction via the control means 65 cooperates so as to be able to close the lower housing member 61 above the air supply means. The nozzle-shaped inlet opening 67 of an ascending pipe 66 is shown at a distance above the valve. In order to prevent that sand in the housing member 61 falls into the air duct, the valve means is closed in the starting phase until a sufficient air pressure prevails below the valve, which serves for reliably conveying the sand into the ascending pipe 66 when the valve is opened.

A deflection means 70 in the form of a sheet is arranged in the lower housing member 61 below the transfer pipe 69 and above the inlet transfer pipe 68. This sheet covers half of the interior of the housing 61 and has an inclination the same as that of the outlet transfer pipe 69.

The sand conveyed upwardly in the ascending pipe impinges on the deflection means 70 and can slip into the outlet transfer line 69. When the pipe does not accommodate the sand, the excessive sand moves downwardly and is again conveyed upwardly through the ascending pipe 66.

Figure 6:
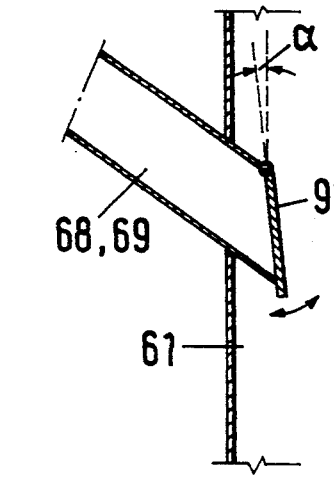
FIG. 6 shows a detail of a modification.

A shutter 90 may be provided at the end of each transfer pipe. This shutter is inclined at an angle alpha, $\alpha$, (FIG. 6) in such a way that the sand sinking down in the housing 61 closes the shutter. The shutter does not open until the sand level in the housing 61 has fallen below the shutter level.

The automatic flow through the entire plant is achieved by this shutter 90.

When the stop valve is opened at the end of a separation row, the sand automatically starts to slip again in all separators.

By this, the flow rate of the sand through the arrangement controls in a simple manner the residence time of the sand in the arrangement and thus the reconditioning period.

A precipitator 75 is arranged in free fashion in the upper double-tapered housing member 60, approximately at the height of the cylindrical middle section of greatest diameter of the housing member 60.

Figure 4:
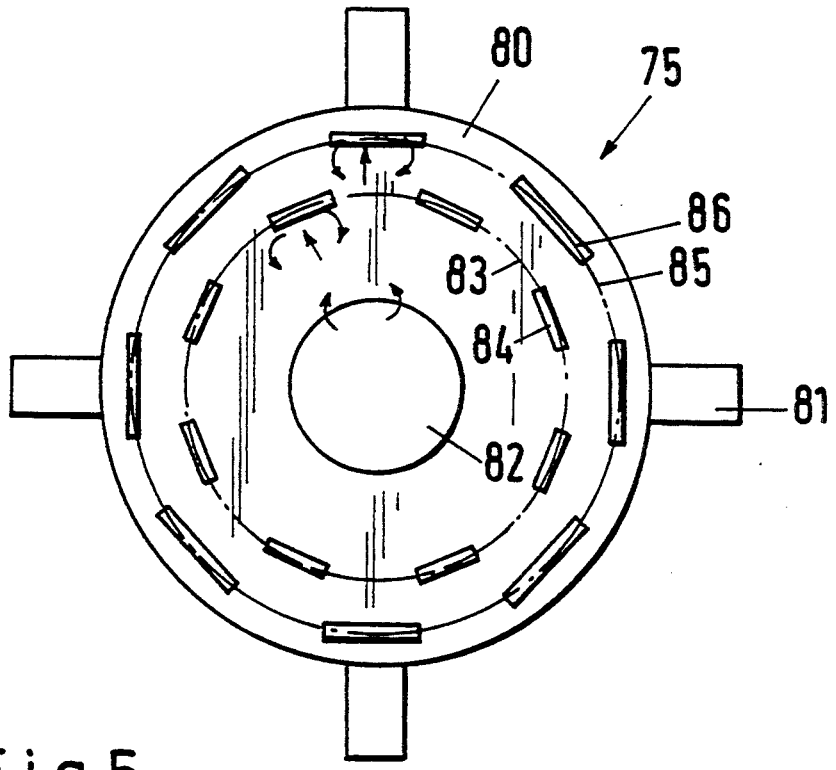
FIG. 4 shows the precipitator used for the separator cell from below.
Figure 5:
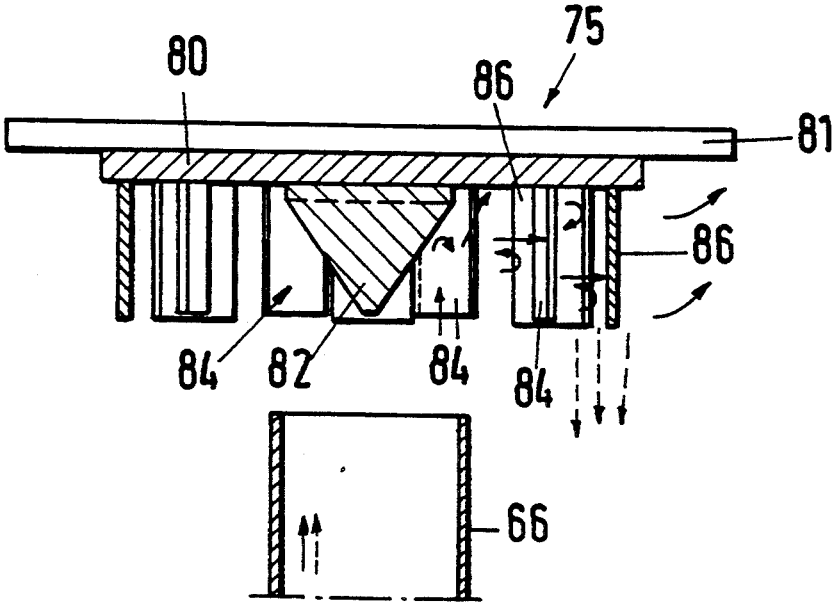
FIG. 5 shows the precipitator of FIG. 4 in a perpendicular section.

In the preferred embodiment shown in FIGS. 4 and 5 the precipitator has a planar, preferably circular precipitator plate 80 which is arranged in the center over the outlet of the ascending pipe 66 and transversely to the ascending pipe axis. The middle of the precipitator plate has a deflecting cone 82 pointed towards the bottom. A plurality of individual planar elements project downwardly from the plate 80 perpendicular thereto and in parallel with the ascending pipe 66. Each planar element 84 and 86, respectively, is plane or inwardly concave.

In the preferred embodiment each of the planar elements is distributed on graduated circles 83 and 85, respectively, having differing radii. This embodiment shows two such graduated circles. However, it is also possible to provide more than two graduated circles.

Preferably, each planar element has an approximately rectangular outline, the center line of greater length extending substantially in parallel with the axis of the ascending pipe. The center lines may also be inclined slightly inwardly or outwardly with respect to the ascending pipe axis.

However, it is also possible to at least partially replace the planar elements by V-shaped or semicircular elements which are arranged as described.

The planar elements 84, 86 of graduated circles adjacent in the radial direction are staggered. The peripheral width of the elements 86 in the outer graduated circle corresponds approximately to the effective peripheral distance between these elements or is only somewhat larger. The peripheral width of the planar elements 84 on the radial inner graduated circle 83 is approximately equal to, or preferably somewhat smaller than, the effective peripheral distance of the elements 86 of the adjacent outer graduated circle.

The stream of mass leaving the ascending pipe 66 impinges on the deflecting cone 82, thus being expanded, deflected and swirled, and impinges on the planar elements of the adjacent graduated circle 83 where the .expanded stream is divided into a plurality of partial streams, with some partial streams being deflected and swirled thus influencing and swirling the adjacent partial streams as well. The partial streams passing through between the elements of the inner graduated circle impinge on the elements of the outer partial circle where they are deflected and swirled. In the most confined space possible, a strongly swirled fluidized sand bed forms with strong inner friction between the sand grains and numerous friction surfaces on cones 82, plate 80 and elements 84 and 86.

Due to this strong mechanical friction and swirling the binder covers are separated intensely and classification of the sand grains and sorting between sand and separated cover particles and foreign matter take place simultaneously. The sand grains fall downwardly and reach the annular storage space between housing member 61 and ascending pipe while the separated fines and impurities leave the baffle-like precipitator 75 radially and are supplied with the air to the outlet connection 77.

In some cases, it may be useful to dispose a downwardly tapering hollow truncated cone 66*a* below the deflecting element 75, onto which the sand particles impinge which on account of the air still have sufficient energy and external motion, while the air partially flowing off downwardly along the planiform elements in this area flows upwardly in this region, transversely to the motion of the sand mass, and thus can tear along further fines. The funnel element 66*a* supplies the sand cloud to the annular cavity disposed underneath.

The air and the fines are collected in the collector 41 and 51, respectively, and supplied to the separator. A coarse separator may be connected thereto, through which the coarser particles are separated prematurely and supplied again to the feed point of the separator 1 and separator 10, respectively, through pipe 41 or the like.

If the separator is stopped for reasons of inspection or repair, the sand still contained in the separator cells can easily be removed downwardly through the inclined air supply pipe 40*a* or 50*a* by lowering the valve elements 64.

We claim:

1. An arrangement for dry reconditioning of used foundry sands in which sand particles of used sand covered by covers and impurities are fluidized in a mixture with air of ambient temperature or a heated air/gas mixture and supplied to a multi-cell separator for mechanical loosening of said covers and impurities from said sand particles and for separating said sand particles from said covers and impurities, in which each separator cell comprises:

an ascending pipe open at both ends and being adapted to receive said mixture of air/gas and used foundry sand at its lower end and to expel said mixture at its upper end in the form of a jet directed along an axis of said pipe, feed means including a fan for supplying said mixture of air/gas and used foundry sand to the lower end of the ascending pipe, a precipitator arranged at a distance above and opposite said upper end of the ascending pipe, comprising surfaces arranged so that said jet impinges on and is deflected by said surfaces whereby covers and impurities are loosened from the sand particles by impact, the apparatus being characterized in that the precipitator of each separator cell comprises:

means arranged opposite of said upper end of said ascending pipe for deflecting and expanding said jet to flow in directions substantially perpendicular to and radially outwardly from said axis of said ascending pipe and a plurality of stationary baffle elements distributed on at least two circles which are radially spaced apart from each other relative to said axis radially outwardly from said deflecting means so that each element projects into said radially expanding flow of said deflected jet to divide it into a plurality of partial swirling streams and provide strong mechanical friction between said sand particles and surfaces of said elements.

2. The arrangement se forth in claim 1, wherein said baffle elements are staggered along said two concentric circles with respect to each other in circumferential directions along said circles.

3. The arrangement set forth in claim 2 wherein, as viewed from said axis of said ascending pipe, said baffle elements are spaced apart on each of said circles by a dimension substantially corresponding to a circumferential dimension of said elements.

4. The arrangement set forth in claim 3 wherein, as viewed from said axis of said ascending pipe, said baffle elements along said inner circle have a width dimension substantially corresponding to a spacing dimension between said elements in said outer circle.

5. The arrangement set forth in claim 1 wherein each baffle element is slightly concave baffle plate generally concentric with said axis of said pipe so that impinging surfaces of said baffle elements are generally concentric to said axis.

6. The arrangement set forth in claim 1 wherein each baffle element has a rectangular outline as viewed from said axis with its longer dimension being generally parallel to said axis.

7. The arrangement set forth in claim 1 wherein said precipitator further comprises a substantially flat plate mounted perpendicular to said axis, said baffle elements are mounted on said plate to project perpendicularly downwardly from said plate radially outwardly of said axis along said circles and said deflecting means is mounted on said plate radially inwardly from said circles and substantially aligned with said axis.

8. The arrangement set forth in claim 7 wherein said deflecting means is a conical body having a tip directed downwardly toward said upper end of said pipe and substantially aligned with said axis.

9. The arrangement set forth in claim 7 wherein said circles have radii chosen as a function of the velocity and diameter of said jet such that impact removal of said covers and sorting of said sand particles and removed covers and impurities takes place in a zone between said deflecting means and said outer circle.

10. The arrangement set forth in claim 1 wherein said baffle elements are V-shaped when viewed in the direction along said axis.

11. The arrangement set forth in claim 1 further comprising means for including a housing for collecting said separated sand particles in each cell, said pipe and said precipitator being mounted within said housing, a transfer pipe extending from one separator cell to a next separator cell for conveying said sand particles to said next cell and introducing said sand particles into said housing of said next cell at a location above said lower end of said ascending pipe, a shutter disposed at an outlet end of said transfer pipe for introducing said sand particles into said housing of said next cell at a location above said lower end of said ascending pipe in said next cell so as to be closed by sand sinking downwardly in said housing of said next cell until said sinking sand falls below said shutter location.

12. The arrangement set forth in claim 1 wherein said precipitator of each of said separator cells is arranged within a double-conical part of a separator cell housing leaving a gap between an inner wall of said double conical part and the periphery of said precipitator, said gap having a width of at least half of a radial dimension of said precipitator and wherein said upper truncated cone has an outlet therein for removing said loosened and separated covers and impurities from said cell.

13. The arrangement set forth in claim 1 wherein, in a direction of flow from one cell to successive cells in said separator, said cells are lined up along a line slanted downwardly at an angle, preferably in dense fashion, and supply inlets and discharge outlets of each cell as well as transfer pipes between adjacent cells extend in a correspondingly inclined fashion.

* * * * *

UNITED STATES PATENT AND TRADEMARK OFFICE

CERTIFICATE OF CORRECTION

PATENT NO. : 5,421,462

DATED : June 6, 1995

INVENTOR(S) : Hofbauer, et al.

It is certified that error appears in the above-indentified patent and that said Letters Patent is hereby corrected as shown below:

Column 7, line 39 (claim 2) "se" should read --set--

Column 8, line 59, insert the following claim.

14. The arrangement set forth in Claim 13 wherein said air/gas mixture is heated below a maximum temperature of 550°.

Signed and Sealed this

Thirty-first Day of October 1995

Bruce Lehman

*Attest:*

BRUCE LEHMAN

*Attesting Officer*

*Commissioner of Patents and Trademarks*